US007028681B2

(12) United States Patent
Suda et al.

(10) Patent No.: US 7,028,681 B2
(45) Date of Patent: Apr. 18, 2006

(54) TWIN CARBURETOR FOR V-TYPE ENGINE

(75) Inventors: Kenichi Suda, Kawasaki (JP); Makoto Enomoto, Kawasaki (JP)

(73) Assignee: Keihin Corporation, Tokyo (JP)

( * ) Notice: Subject to any disclaimer, the term of this patent is extended or adjusted under 35 U.S.C. 154(b) by 417 days.

(21) Appl. No.: 10/657,658

(22) Filed: Sep. 8, 2003

(65) Prior Publication Data

US 2004/0154598 A1 Aug. 12, 2004

(30) Foreign Application Priority Data

Feb. 10, 2003 (JP) ..... 2003-031939

(51) Int. Cl.
*F02B 13/00* (2006.01)

(52) U.S. Cl. ..... 123/580; 123/54.4; 123/583

(58) Field of Classification Search ..... 123/583, 123/54.4, 184.38, 579, 184.32, 580, 584, 123/336

See application file for complete search history.

(56) References Cited

U.S. PATENT DOCUMENTS 1,462,782 A * 7/1923 Barbarou ..... 123/579
2,192,067 A * 2/1940 Betry ..... 123/549
6,205,986 B1 3/2001 Nojima et al.

* cited by examiner

*Primary Examiner*—Andrew M. Dolinar
*Assistant Examiner*—Katrina Harris
(74) *Attorney, Agent, or Firm*—R. Neil Sudol; Henry D. Coleman; William J. Sapone

(57) ABSTRACT

To improve productivity of a connection member between first and second carburetors, and to reduce maintenance work area for a main drive throttle valve lever, a driven throttle valve lever and a connection lever, a main drive throttle valve lever is arranged to protrude in one side of a first carburetor, a driven throttle valve lever is arranged to protrude in one side of a second carburetor, the main drive throttle valve lever and the driven throttle valve lever are connected in one side by a connection lever. A cup member provided with a bottom portion and a peripheral wall portion and formed in a cup shape is arranged fixedly in one side of the first and second carburetors, the first and second carburetors are connected by the cup member, an opening portion of the cup member is closed by a cover member, and the main drive throttle valve lever, the driven throttle valve lever and the connection lever are arranged so as to be received inside the cup member closed by the cover member.

4 Claims, 7 Drawing Sheets

TWIN CARBURETOR FOR V-TYPE ENGINE

BACKGROUND OF THE INVENTION

1. Field of the Invention

The present invention relates to a carburetor for regulating and controlling an amount and a concentration of an air-fuel mixture supplied to an engine, and more particularly to a twin carburetor for a V-type engine provided with a first carburetor and a second carburetor which are connected to respective cylinders constituting the V-type engine, in which a main drive throttle valve lever provided in the first carburetor and a driven throttle valve lever provided in the second carburetor are connected in an interlocking manner by a connection lever, and the first carburetor and the second carburetor are fixed by a mechanical connection.

2. Description of Conventional Art

A conventional twin carburetor for the V-type engine is shown in Japanese Unexamined Patent Publication No. 2000-179407. In this structure, a first carburetor connected to a first cylinder and a second carburetor connected to a second cylinder are arranged so that centers of intake passages thereof are aligned with each other, the carburetors are fixed to each other by a connection plate which is arranged in parallel to the centers of the intake passages, and a connection link connecting the throttle valve levers of the respective carburetors in an interlocking manner is arranged in parallel to the centers of the intake passages.

In accordance with the conventional twin carburetors for the V-type engine, the connection plate is manufactured by press molding of a sheet material. In this case, in order to increase a mechanical rigid strength of the connection plate, a thickness thereof is increased or a rib is provided. In accordance with this structure, since it is hard to press mold and a reduction in productivity is caused, this structure is not preferable. Further, since the main drive throttle valve lever attached to a throttle valve shaft of the first carburetor, the driven throttle valve lever attached to the second carburetor and the connection link connecting the main drive throttle valve lever to the driven throttle valve lever in an interlocking manner are arranged in a side portion of each of the carburetor in an exposed manner, foreign materials such as dusts, mud or the like are attached to the main drive throttle valve lever, the driven throttle valve lever and the connection link, at an operating time of a vehicle, and the frequency of maintenance work is increased, so that it is not preferable. Further, since the lever, the link and the like are exposed, it is impossible to arrange an outer appearance neatly. In particular, the defects mentioned above generate problems in a two-wheeled vehicle, a four-wheeled vehicle or the like in which the engine is directly exposed outside.

SUMMARY OF THE INVENTION

The present invention is made by taking the defects mentioned above into consideration, and an object of the present invention is to provide a twin carburetor for a V-type engine in which it is possible to improve a productivity of a connection member for fixing a first carburetor and a second carburetor, it is possible to reduce a maintenance work area with respect to a main drive throttle valve lever, a driven throttle valve lever and a connection lever, and it is possible to improve an outer appearance of a whole of the carburetor. This twin carburetor for the V-type engine is particularly suitable for a vehicle such as a two-wheeled vehicle, a four-wheeled vehicle or the like, in which an engine is exposed.

In accordance with a first aspect of the present invention, there is provided a twin carburetor for a V-type engine provided with a first carburetor and a second carburetor which are connected to respective cylinders constituting the V-type engine, in which a main drive throttle valve lever provided in the first carburetor and a driven throttle valve lever provided in the second carburetor are connected in an interlocking manner by a connection lever, and the centers of intake passages of the respective carburetors are arranged on the same line, wherein a cup member formed in a cup shape is provided with a peripheral wall portion upstanding from a bottom portion toward an above opening portion, a wire support portion for an accelerator wire being inserted thereto, and a threaded hole for a stop screw, the cup member is arranged in parallel to the center of an intake passage in each of the carburetors and is arranged fixedly onto one side end surface of each of the carburetors, the opening portion of the cup member is closed and held by a cover member, and the main drive throttle valve lever, the driven throttle valve lever and the connection lever are arranged so as to be received within the cup member including the cover member.

Further, in accordance with a second aspect of the present invention, in addition to the first aspect, a first insertion hole capable of having the main drive throttle valve lever inserted thereto and a second insertion hole capable of having the driven throttle valve lever inserted thereto are provided in a bottom portion of the cup portion, the main drive throttle valve lever is received within the cup member via the first insertion hole, the driven throttle valve lever is received within the cup member via the second insertion hole, an opening portion of the first insertion hole is closed by an end surface of a first closing boss provided in the first carburetor, and an opening portion of the second insertion hole is closed by an end surface of a second closing boss provided in the second carburetor.

Further, in accordance with a third aspect of the present invention, in addition to the first aspect mentioned above, the connection lever is arranged near the opening portion of the cup member.

Still further, in accordance with a fourth aspect of the present invention, in addition to the first aspect mentioned above, a drain hole is provided in a bottom portion of the cup member in the gravitational direction.

In accordance with the first aspect of the present invention, since the main drive throttle valve lever, the driven throttle valve lever and the connection lever which are arranged in the side of the first carburetor and the second carburetor are arranged so as to be received within the cup member closed by the cover member, a risk of foreign materials being attached to each of the levers is reduced, and outer appearance can be improved. Further, since the cup member is formed in a cup shape and is provided with the peripheral wall portion, the cup member can be made by thin wall injection molding with using a metal material such as an aluminum alloy or the like, it is possible to make rigidity high and it is possible to improve productivity. Further, since the wire support portion for mounting the acceleration wire to the cup member and the threaded hole for the stop screw can be integrally provided, it is possible to arrange them compact.

In accordance with the second aspect of the present invention, the main drive throttle valve lever is previously assembled in the first carburetor, the driven throttle valve lever is previously assembled in the second carburetor, the main drive throttle valve lever is arranged so as to be inserted into the cup member via the first insertion hole of the cup member in such a state, the driven throttle valve lever is arranged so as to be inserted into the cup member via the second insertion hole, and the cup member is fixed toward the first carburetor and the second carburetor in this state. Further, at this time, the opening portion of the first insertion hole open to the bottom portion of the cup member is closed by the end surface of the first closing boss in the first carburetor, and the opening portion of the second insertion hole is closed by the end surface of the second closing boss in the second carburetor.

Further, in accordance with the third aspect of the present invention, the connection lever is structured such that one end of the connection lever is connected to the main drive lever and another end is connected to the driven throttle valve lever after the main drive throttle valve lever and the driven throttle valve lever are arranged so as to be received within the cup member. Accordingly, since the connection lever is arranged near the opening portion of the cup member, it is possible to easily connect the connection lever.

Still further, in accordance with the fourth aspect of the present invention, even when a dew condensation is generated within the cup member, or a water, a sea water or the like enters into the cup member, it is possible to immediately discharge them outside via the drain hole.

DESCRIPTION OF THE PREFERRED EMBODIMENT

Figure 1:
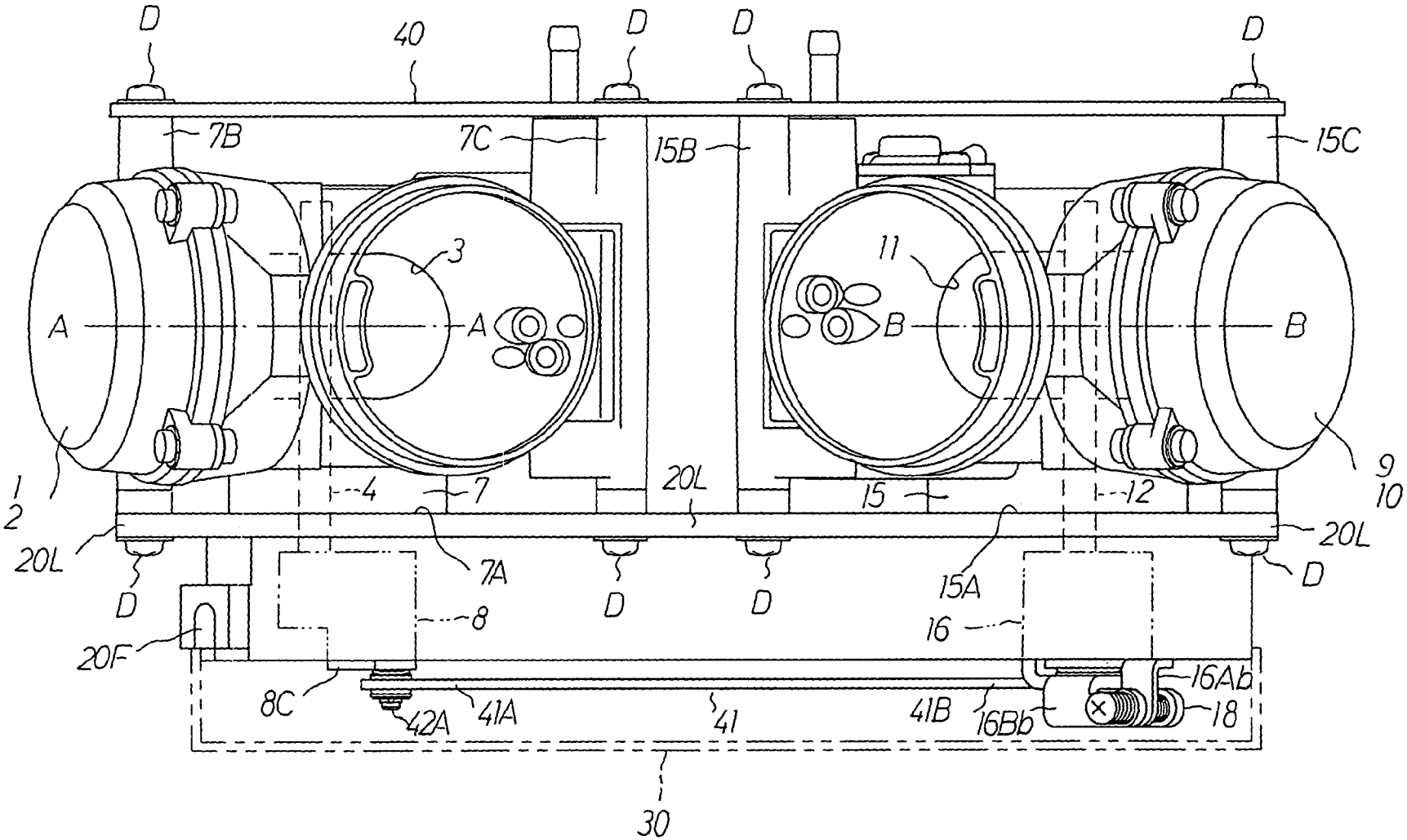
FIG. 1 is a plan view of an upper portion of a twin carburetor for a V-type engine in accordance with the present invention.
Figure 2:
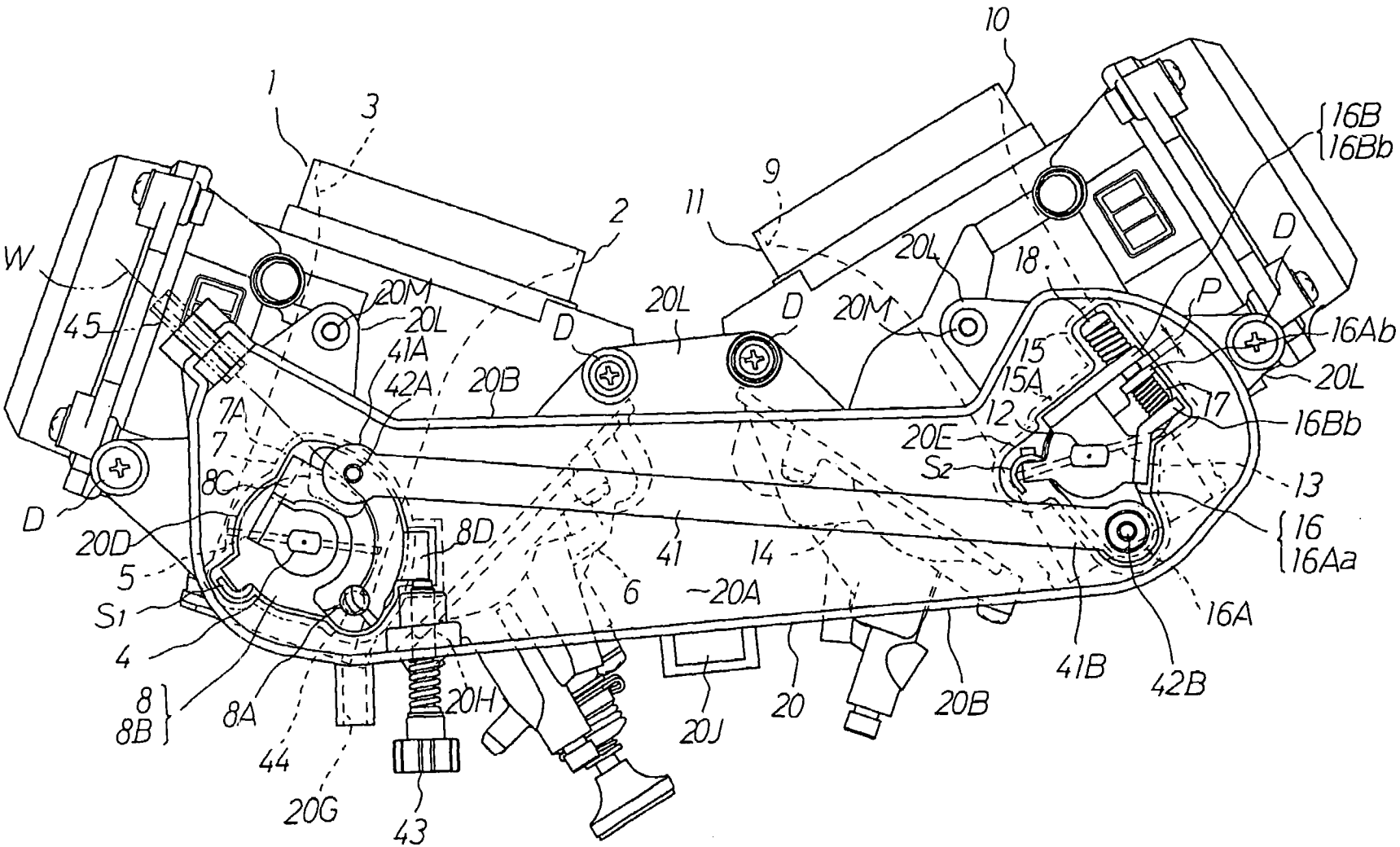
FIG. 2 is a side view of the lower side in FIG. 1.
Figure 3:
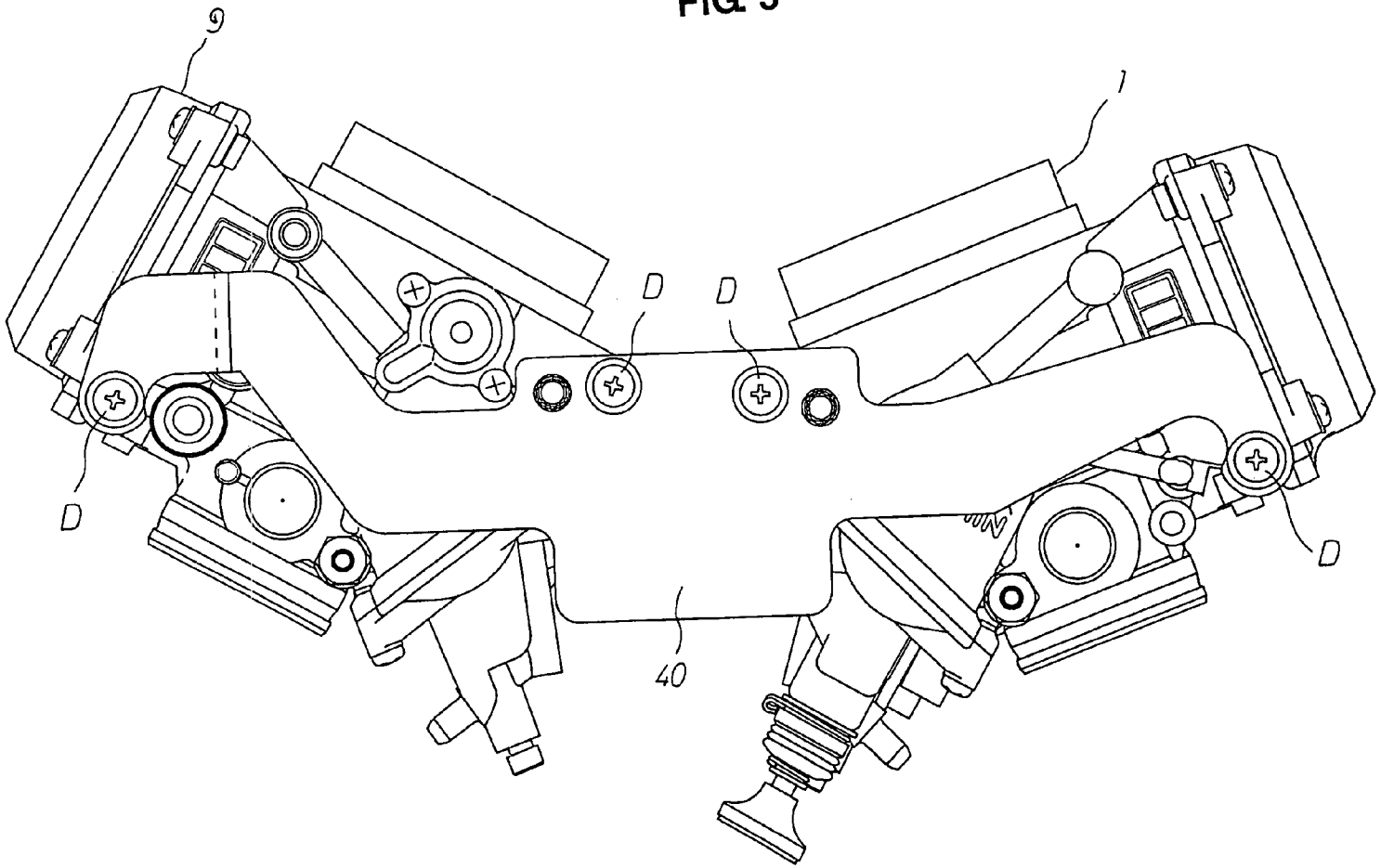
FIG. 3 is a side view of the upper side in FIG. 1.

A description will be given below of one embodiment of a twin carburetor for a V-type engine in accordance with the present invention. FIG. 1 is a plan view of an upper portion of the twin carburetor for the V-type engine, FIG. 2 is a side view of the lower side in FIG. 1, and FIG. 3 is a side view of the upper side in FIG. 1. In this case, in the following description, the upper, lower, right and left sides respectively mean directions or positions on the drawings. Reference numeral 1 denotes a first carburetor connected to a first cylinder (not shown) constituting the V-type engine. An intake passage 3 open obliquely downward is provided through in a first carburetor main body 2 in a penetrating manner, and the intake passage is opened and closed by a first throttle valve 5 mounted to a first throttle valve shaft 4 which is rotatably supported to the carburetor main body 2 across the intake passage 3. Further, a float chamber main body 6 is mounted to a right side portion in FIG. 2 of the first carburetor main body 2, and a fixed fuel liquid surface is formed within a float chamber which is formed by the float chamber main body 6. The first throttle valve shaft protrudes downward further than an end surface 7A of a first closing boss 7 which is formed so as to surround the outer periphery of the first throttle valve shaft 4 and formed so as to protrude downward from the first carburetor main body 2 in FIG. 1. (This first throttle valve shaft 4 is shown by a dotted line in FIG. 1.) Further, a main drive throttle valve lever 8 to be mentioned below is mounted to the lower end in FIG. 1 of the first throttle valve shaft 4 (in other words, an end portion of the first throttle valve shaft 4 protruding downward from the end surface 7A of the first closing boss 7). The main drive throttle valve lever 8 is constituted by a first main drive lever portion 8B provided with a wire end hole 8A and a stopper portion 8D brought into contact with a stop screw to be mentioned below, and a second main drive lever portion 8C for mounting a connection lever to be mentioned below, and the first main drive lever portion 8B and the second main drive lever portion 8C are firmly fixed to an end portion of the first throttle valve shaft 4. At this time, the main drive throttle valve lever 8 constituted by the first main drive lever portion 8B and the second main drive lever portion 8C which are firmly fixed to the end portion of the first throttle valve shaft 4 is arranged so as to protrude from the end surface 7A of the first closing boss 7, and is arranged so as to protrude bownward from the end surface 7A in FIG. 1. Reference numeral 9 denotes a second carburetor connected to a second cylinder (not shown) constituting the V-type engine. An intake passage 11 open obliquely downward is provided through in a second carburetor main body 10, and the intake passage is opened and closed by a second throttle valve 13 mounted to a second throttle valve shaft 12 which is rotatably supported to the second carburetor main body 10 across the intake passage 11. Further, a float chamber main body 14 is mounted to a left side portion in FIG. 2 of the second carburetor main body 10, and a fixed fuel liquid surface is formed within a float chamber which is formed by the float chamber main body 14. The second throttle valve shaft protrudes downward further than a downward end surface 15A of a second closed boss 15 which is formed so as to surround the outer periphery of the second throttle valve shaft 12 and formed so as to protrude downward from the second carburetor main body 10 in FIG. 1. (This second throttle valve shaft 12 is shown by a dotted line in FIG. 1.) Further, a driven throttle valve lever 16 to be mentioned below is mounted to the lower end in FIG. 1 of the second throttle valve shaft 12 (in other words, an end portion of the second throttle valve shaft 12 protruding downward from the end surface 15A of the second closed boss 15). The driven throttle valve lever 16 is constituted by a first driven lever portion 16A which is rotatably arranged in the second throttle valve shaft 12, and a second driven lever portion 16B which is firmly fixed to the second throttle valve shaft 12. The first driven lever portion 16A is rotatably arranged in the second throttle valve shaft 12 as mentioned above, and is provided with a connection portion 16Aa which is connected to a connection lever to be mentioned below, and a transmission tongue portion 16Ab which is formed by bending. The second driven lever portion 16B is arranged by being firmly fixed to the second throttle valve shaft 12 as mentioned above, and is provided with fork tongue portions 16Ba and 16Bb which are formed by being bent in a fork shape, and the driven tongue portion 16Ab of the first driven lever portion 16A is arranged in a gap between the fork tongue portions 16Ba and 16Bb. Further, the first driven lever portion 16A and the second driven lever portion 16B are connected by arranging a transmission spring 17 compressedly between one fork tongue portion 16Bb and the lower end of the transmission tongue portion 16Ab, and bringing the leading end of a tuning screw 18 screwed with another fork tongue portion 16Bb into contact with the upper end of the transmission tongue portion 16Ab. In other words, the transmission tongue portion 16Ab of the first driven lever portion 16A is clamped in the second driven lever portion 16B by the transmission spring 17 and the tuning screw 18. In this case, reference symbol S1 denotes a first throttle valve return spring which applies a rotation force in the closing direction of the first throttle valve 5 to the main drive throttle valve lever 8. One end of the first throttle valve return spring S1 is engaged with the first main drive lever portion 8B, and another end thereof is engaged with the first carburetor main body 2. Further, reference symbol S2 denotes a second throttle valve return spring which applies a rotation force in the closing direction of the second throttle valve 13 to the driven throttle valve lever 16. One end of the second throttle valve return spring S2 is engaged with the second driven lever portion 16B, and another end thereof is engaged with the second carburetor main body 10.

Figure 4:
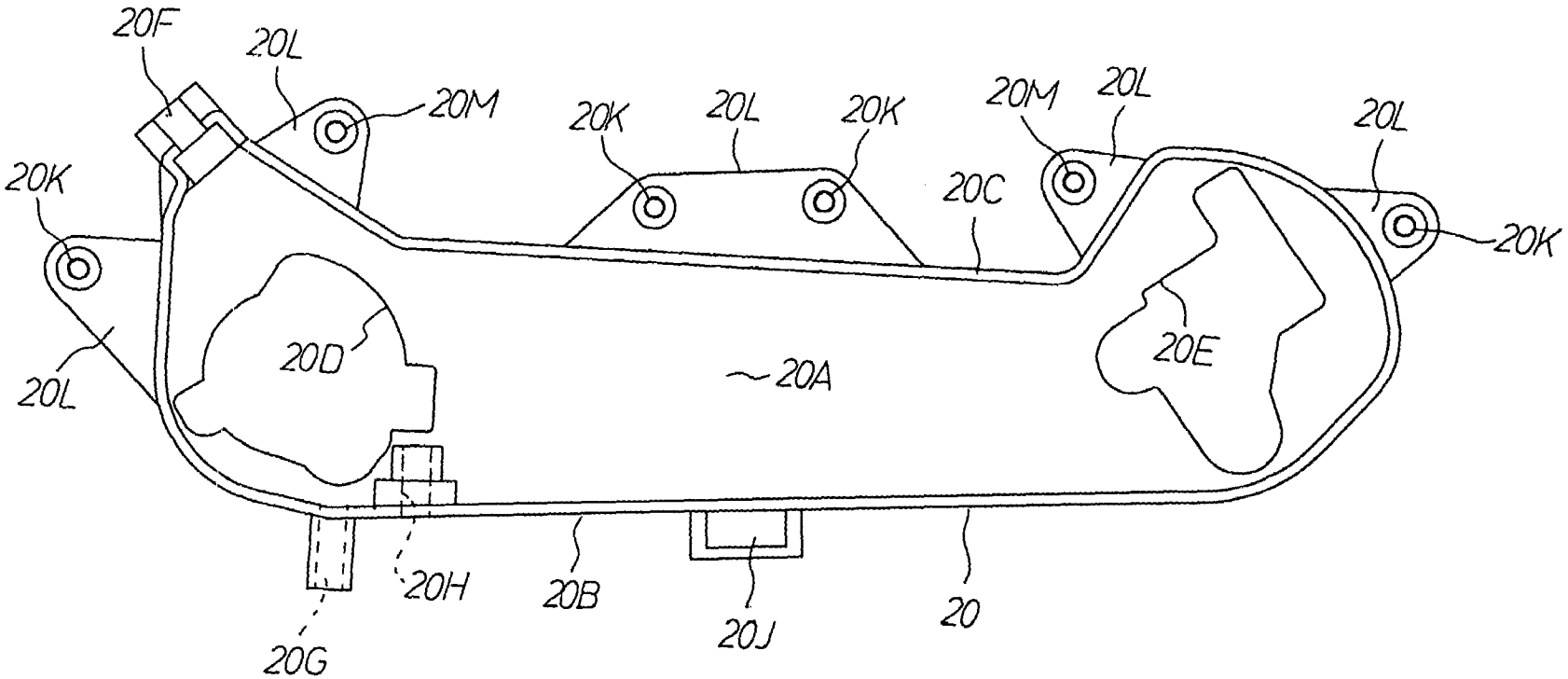
FIG. 4 is a plan view of an upper portion of a cup member used in FIG. 1.
Figure 5:
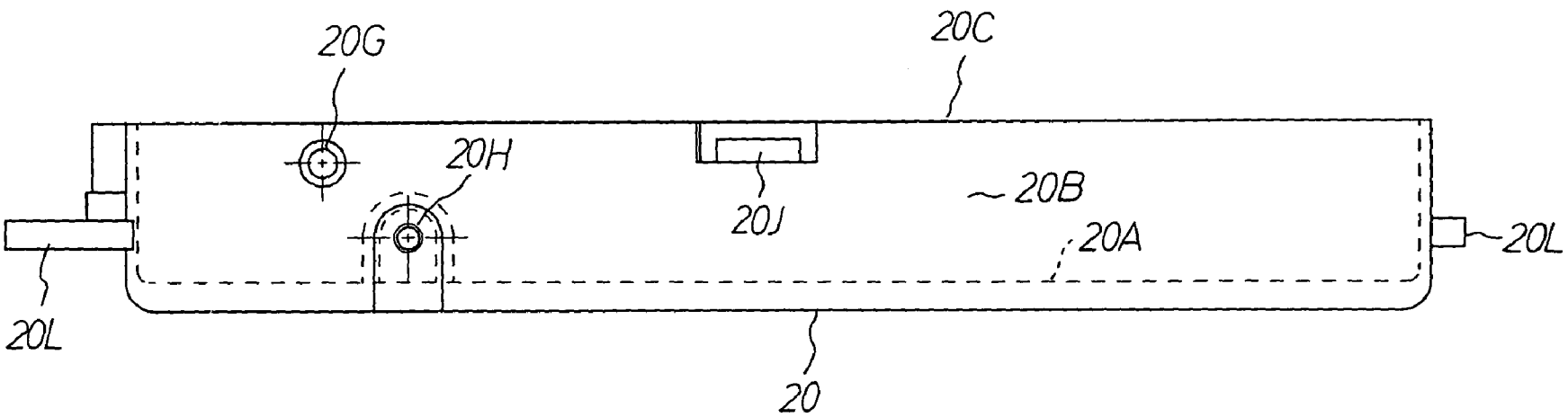
FIG. 5 is a side view of the lower side in FIG. 4.

Next, a description will be given of the cup member with reference to FIGS. 4 and 5. FIG. 4 is a plan view of the cup member, and FIG. 5 is a lower side elevational view as seen in the direction from the lower side in FIG. 4. The cup member 20 is formed in a cup shape, and is provided with a peripheral wall portion 20B formed in an annular shape upward from a bottom portion 20A, and the upper side of the peripheral wall portion 20B is open by an opening portion 20C. A first insertion hole 20D is provided through in the left side of the bottom portion 20A of the cup member 20, and a second insertion hole 20E is provided through in the right side thereof. Further, a hole shape of the first insertion hole 20D is formed in a shape slightly larger than the plane shape of the main drive throttle valve lever 8, and a hole shape of the second insertion hole 20E is formed in a shape slightly larger than the plane shape of the driven throttle valve lever 16. The plane shape of the main drive throttle valve lever 8 and the plane shape of the driven throttle valve lever 16 means shapes seen in the longitudinal axial directions (the direction of the front to the back of the paper surface in FIG. 2) of the first throttle valve shaft 4 and the second throttle valve shaft 12, and shapes of the main drive throttle valve lever 8 and the driven throttle valve lever 16 shown in FIG. 2 correspond to those plane shapes. Further, a wire support portion 20F is provided in the upper side of the left end in the peripheral wall portion 20B. Further, a drain hole 20G is provided through in the lower side of the peripheral wall portion 20B, and a threaded hole 20H for a stop screw is formed therein, and a mounting hole 20J is formed outward from the peripheral wall portion 20B. Further, reference symbol 20K denotes a carburetor main body mounting hole which is provided through in a collar portion 20L extending sideward from the peripheral wall portion 20B. In the present embodiment, each one of the carburetor main body mounting holes 20K is formed in both the right and left ends, and two carburetor main body mounting holes 20K are formed in a center portion. Further, a cover member mounting threaded hole 20M is provided through in the collar portion 20L extending sideward from the peripheral wall portion 20B, and in the present embodiment, each one of the cover member mounting screw 20M is formed in the right and the left.

Figure 6:
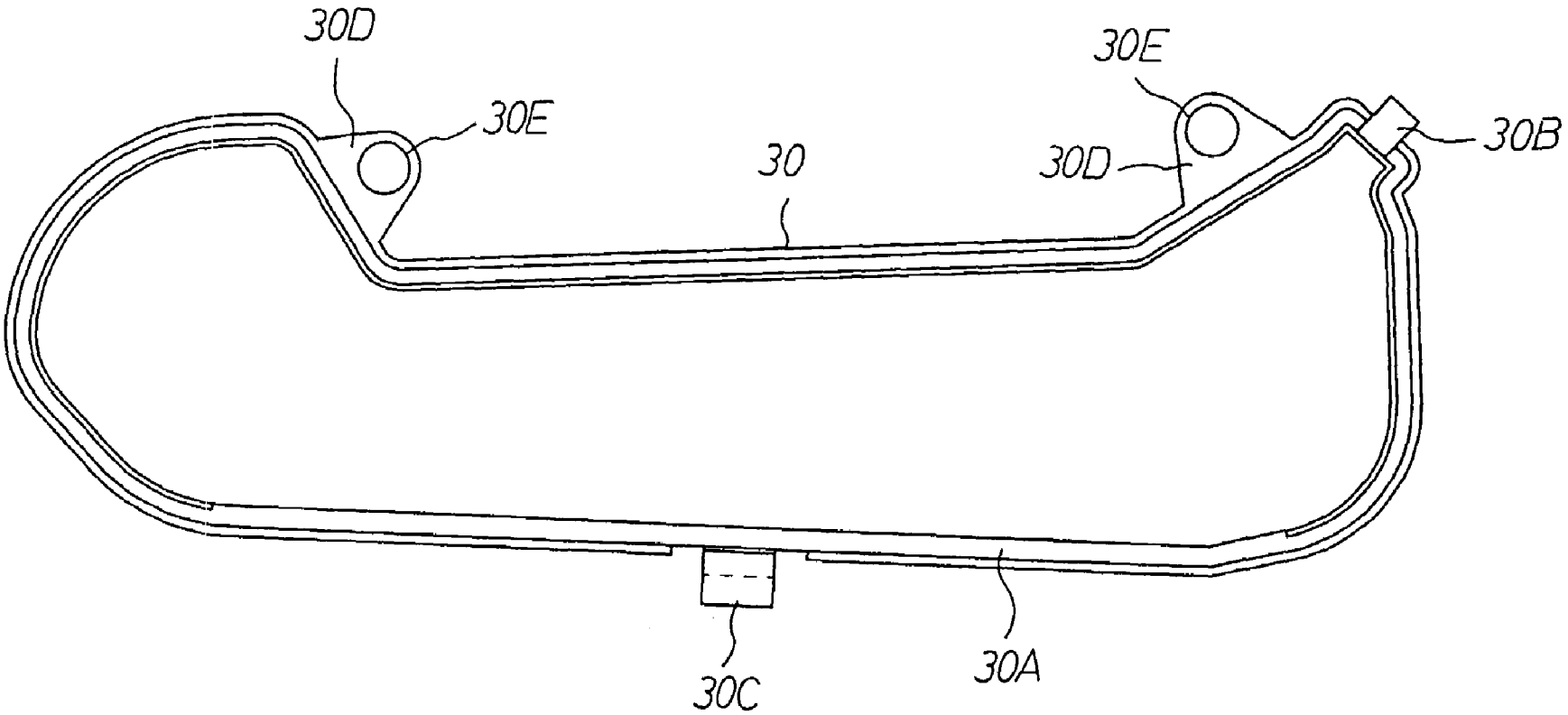
FIG. 6 is a plan view of an upper portion of a cover member used in FIG. 1.
Figure 7:
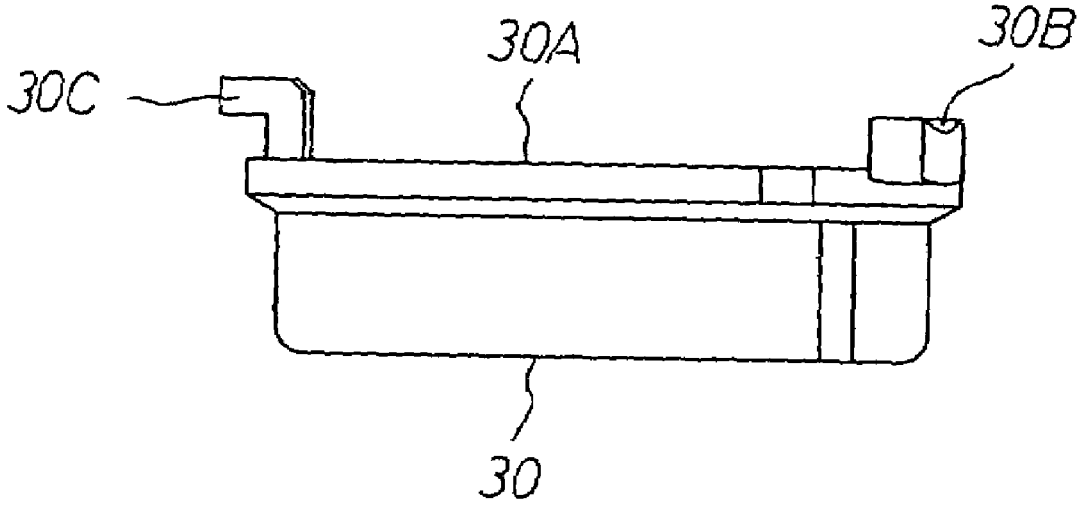
FIG. 7 is a side view of the right side in FIG. 6.

Next, a description will be given of a cover member closing the opening portion 20C of the cup member 20 with reference to FIGS. 6 and 7. FIG. 6 is a plan view of an upper portion of a cover member 30, and FIG. 7 is a right side view of FIG. 6. The cover member 30 is formed in a cup shape, a shape of an opening portion 30A thereof is formed in the same shape as that of the opening portion 20C of the cup member 20, and a wire support portion 30B aligning with the wire support portion 20F of the cup member 20 is formed. Further, a cup member engagement portion 30C is formed in the lower side in FIG. 6 of the cover member 30, and this cup member engagement portion 30C is arranged so as to align with the mounting hole 20J of the cup member 20 and is formed in an L-shape upward the upper side from the opening portion 30A. Further, a cup member mounting hole 30E is provided through in a collar portion 30D extending outward from the cover member 30. In this case, one cup member mounting hole 30E is provided in each of the right and the left, and the cup member mounting hole 30E is arranged so as to be aligned with the cover member mounting threaded hole 20M of the cup member 20.

A description will be next given of assembling the twin carburetor for the V-type engine. The first carburetor 1 has been completely assembled as a single carburetor. In the first carburetor 1, the first throttle valve 5 is mounted to the first throttle valve shaft 4, and the main drive throttle valve lever 8 formed by the first main drive lever portion 8B and the second main drive lever portion 8C is mounted to an end portion of the first throttle valve shaft 4 protruding outward (downward in FIG. 1) from the end surface 7A of the first closing boss 7. Further, the second carburetor 9 has been completely assembled as a single carburetor. In the second carburetor 9, the second throttle valve 13 is mounted to the second throttle valve shaft 12, and the driven throttle valve lever 16 formed by the first driven lever portion 16A and the second driven lever portion 16B is mounted to an end portion of the second throttle valve shaft 12 protruding outward (downward in FIG. 1) from the end surface 15A of the second closing boss 15. In this state, the first throttle valve 5 is energized in the closing direction by a spring force of the first throttle valve return spring S1, and is in a state of closing the intake passage 3, whereby the main drive throttle valve lever 8 is held at a position shown in FIG. 2. Further, the second throttle valve 13 is energized in the closing direction by a spring force of the second throttle valve return spring S2, and is in a state of closing the intake passage 11, and the driven throttle valve lever 16 is held at a position shown in FIG. 2. Then, the first carburetor 1 and the second carburetor 9 are obliquely arranged so that centers A—A and B—B of the respective intake passages 3 and 11 are arranged on the same line and downstream sides of the respective intake passages 3 and 11 are directed obliquely outward. A state in which the first carburetor 1 and the second carburetor 9 are arranged is well shown in FIG. 2.

Next, the bottom portion 20A of the cup member 20 is arranged on the end surface 7A of the first closing boss 7 in the first carburetor 1 and on the end surface 15A of the second closing boss 15 in the second carburetor 9 so as to be brought into contact therewith, and at this time, the main drive throttle valve lever 8 constituted by the first main drive lever portion 8B and the second main drive lever portion 8C is arranged so as to be received inside the cup member 20 via the first insertion hole 20D provided to be open in the bottom portion 20A of the cup member 20. Further, the driven throttle valve lever 16 constituted by the first driven lever portion 16A and the second driven lever portion 16B is arranged so as to be received inside the cup member 20 via the second insertion hole 20E provided to be open in the bottom portion 20A of the cup member 20. Such arrangement that the throttle valve levers 8 and 16 can be respectively received inside the cup member 20 via the insertion holes 20D and 20E as mentioned above can be achieved by the structure that the hole shapes of the first insertion hole 20D is formed slightly larger than the plane shape of the main drive throttle valve lever 8, and the structure that the hole shape of the second insertion hole 20E is formed slightly larger than the plane shape of the driven throttle valve lever 16.

Further, in the state in which the bottom portion 20A of the cup member 20 is arranged to be brought into contact with the end surface 7A of the first closing boss 7 and the end surface 15A of the second closing boss 15, screws D are inserted into the carburetor main body mounting holes 20K of the cup member 20, and the screws are engaged with female threaded holes (not shown) formed in the first carburetor main body 2 and female threaded holes (not shown) formed in the second carburetor main body 10. In particular, the cup member 20 is fixed to each of the carburetor main bodies 2 and 10 by fastening two screws D. Further, in a state in which the cup member 20 is fixed to each of the carburetor main bodies 2 and 10, the opening of the first insertion hole 20D is closed by the end surface 7A of the first closing boss 7, and the opening of the second insertion hole 20E is closed by the end surface 15A of the second closing boss 15. This can be achieved by making the plane shape of the end surface 7A of the first closing boss 7 larger than the first insertion hole 20D, and can be achieved by making the plane shape of the end surface 15A of the second closing boss 15 larger than the second insertion hole 20E.

On the other hand, in FIG. 1, a connection stay 40 formed in a flat shape is arranged on bosses 7B and 7C in the upper side of the first carburetor main body 2 and bosses 15B and 15C in the upper side of the second carburetor main body 10, and this connection stay 40 is also screwed to female holes (not shown) of each of the carburetor main bodies 2 and 10 by the screws D. In the present embodiment, the connection stay 40 is fixed to the bosses 7B and 7C and the bosses 15B and 15C in the upper side of the respective carburetor main bodies 2 and 10 by fastening two screws D. A state in which the connection stay 40 is fastened and fixed to each of the carburetor main bodies 2 and 10 is shown in FIGS. 1 and 3. In accordance with the structure mentioned above, since one side (the lower side in FIG. 1) of each of the carburetor main bodies 2 and 10 is firmly fixed by the cup member 20, and another side (the upper side in FIG. 1) thereof is firmly fixed by the connection stay 40, two adjacent carburetors can be firmly and accurately connected.

Next, the main drive throttle valve lever 8 and the driven throttle valve lever 16 are connected to each other by a connection lever 41. In particular, the left end 41A of the connection lever 41 is rotatably set on a first pin 42A provided to protrude in the second main drive lever portion 8C so as to be connected, and on the other hand, the right end 41B of the connection lever 41 is rotatably set on a second pin 42B provided to protrude in the connection portion 16Aa of the first driven lever 16A so as to be connected. Further, a stop screw 43 is arranged in the threaded hole 20H for the stop screw provided in the cup member 20 and fastened, the leading end of the stop screw 43 is protruded inside the cup member 20, and the leading end is arranged to be in contact with the end surface of the stopper portion 8D of the first main drive lever portion 8B arranged within the cup member 20.

Further, throttle valve opening degree in the first throttle valve 5 of the first carburetor 1 and the second throttle valve 13 of the second carburetor 9 is tuned in accordance with the following manner. First, an idling opening degree of the first throttle valve 5 in the first carburetor 1 is adjusted by turning the stop screw 43. That is, when turning the stop screw 43 so as to make a protruding size of the stop screw 43 into the cup member 20 large, the first main driven lever portion 8B is rotated in the counterclockwise direction, thereby making it possible to adjust the first throttle valve 5 in the opening direction, and when making the protruding size of the stop screw 43 small, the first main drive lever portion 8B is rotated in the clockwise direction, thereby making it possible to adjust the first throttle valve 5 in the closing direction. Accordingly, it is possible to obtain a proper idling opening degree of the first throttle valve 5 by suitably turning the stop screw 43. On the other hand, the second throttle valve 13 of the second carburetor 9 can be tuned with the idling opening degree of the first throttle valve 5 in accordance with the following manner. That is, when making a protruding size P of the first driven lever portion 16A with respect to the transmission tongue portion 16Ab large by turning a tuning screw 18, the second driven lever portion 16B is rotated in the counterclockwise direction, thereby making it possible to adjust the second throttle valve 13 in the opening direction, and, when making the protruding size of the tuning screw 18 small, the second driven lever portion 16B is rotated in the clockwise direction, thereby making it possible to adjust the second throttle valve 13 in the closing direction. Therefore, it is possible to accurately tune the idling opening degree of the second throttle valve 13 to the idling opening degree of the first throttle valve 5 by suitably turning the tuning screw 18.

Further, in the case that the connection lever 41 is arranged near the opening portion 20C of the peripheral wall portion 20B in the cup member 20 in the structure mentioned above, it is possible to improve a working property for connecting the connection lever 41 to the second main drive lever portion 8C of the first carburetor 1, and it is possible to improve a working property for connecting the connection lever 41 to the first driven lever portion 16A of the second carburetor 9. At this time, in particular, in the case that the tuning screw 18 is also arranged near the opening portion 20C of the peripheral wall portion 20B, it is possible to improve a working property for the tuning. Accordingly, it is possible to simultaneously achieve improvement of the working property for connection and improvement of the working property for tuning by arranging the connection lever 41 and the tuning screw 18 near the opening portion 20C of the peripheral wall portion 20B.

Next, a wire end 44 of an accelerator wire W connected to an accelerator grip (not shown) is inserted to the wire end hole 8A of the first main drive lever portion 8B, and the accelerator wire W is drawn out to the exterior via an adjuster pipe 45 mounted to the wire support portion 20F of the cup member 20. The accelerator wire W, the wire end 44 and the adjuster pipe 45 are shown by dotted lines in FIG. 2.

Next, the opening portion 20C of the cup member 20 is closed by the cover member 30. That is, the opening portion 30A of the cover member 30 is arranged on the opening portion 20C of the cup member 20, the cup member engagement portion 30C of the cover member 30 is inserted into the mounting hole 20J of the cup member 20 so as to be engaged, a screw (not shown) is inserted into the cup member mounting hole 30E of the cover member 30 in this state, and the screw is fastened to the cover member mounting threaded hole 20M of the cup member 20, and the opening portion 20C of the cup member 20 is held so as to be closed by the cover member 30. A state in which the cover member 30 is arranged on the opening portion 20C of the cup member 20 is shown by a two-dot chain line in FIG. 1.

In accordance with the twin carburetor for the V-type engine on the basis of the present invention, since the cup member 20 formed by the bottom portion 20A and the annular peripheral wall portion 20B is used for the connection plate in one side, it is possible to largely improve rigidity as the connection plate particularly by the peripheral wall portion, and it is possible to firmly and securely connect the first carburetor 1 to the second carburetor 9. Further, since the cup member can be extremely easily produced by injection molding of aluminum or the like, it is possible to improve productivity of the connection plate in comparison with increasing of thickness or providing of the ribs for increasing a rigidity with respect to the flat material. Further, in the case that the opening portion 20C of the cup member 20 is closed by the cover member 30, and the main drive throttle valve lever 8, the driven throttle valve lever 16 and the connection lever 41 are arranged so as to be received within the space of the closed cup member 20, it is possible to inhibit foreign materials (dirt, water, dust or the like) existing in the periphery of the carburetor from being attached to these elements, it is possible to largely reduce a maintenance work area, and particularly, the structure is suitable for a vehicle such as a two-wheeled vehicle, a four-wheeled vehicle or the like in which the engine is exposed. Further, in accordance with the structure mentioned above, since the main drive throttle valve lever 8, the driven throttle valve lever 16 and the connection lever 41 are not directly exposed outside, it is possible to largely improve an outer appearance of the whole of the carburetor main body. Further, since the rigidity of the cup member 20 can be increased by arranging the peripheral wall portion 20B, the cup member 20 can be provided with the threaded hole 20H for the stop screw and the wire support portion 20F for the accelerator wire W being inserted and supported. In accordance with this structure, it is possible to arrange the threaded hole for the stop screw which has been provided in the carburetor main body and the wire support portion which has been provided in the stay member, concentratedly in the cup member 20. Further, in the case that the first insertion hole 20D provided in the cup member 20 is closed by the end surface 7A of the first closing boss 7 in the first carburetor 1, and the second insertion hole 20E is closed by the end surface 15A of the second closing boss 15 in the second carburetor 9, it is possible to further shut off the inside of the cup member 20 from the ambient air, whereby it is possible to further inhibit the foreign materials from entering into the cup member 20. Further, in the case that the connection lever 41 is arranged near the opening portion 20C of the peripheral wall portion 20B in the cup member 20, it is possible to improve the working property for connecting the main drive throttle valve lever 8 and the driven throttle vale lever 16 to the connection lever 41. Further, in the case that the tuning screw 18 serving a turning operation of the first throttle valve 5 of the first carburetor 1 and the second throttle valve 13 of the second carburetor 9 is arranged near the opening portion 20C of the peripheral wall portion 20B in the cup member 20 in the same manner as mentioned above, it is possible to improve the working property for tuning the second throttle valve 13 of the second carburetor 9. Still further, in the case that the drain hole 20G is provided in the bottom portion (the peripheral wall portion 20B) in the gravitational direction of the cup member 20, even when a dew condensation is generated within the cup member 20, or when water enters into the cup member, it is possible to immediately discharge them outside and it is possible to solve the problem accompanying with the water content.

As described above, in accordance with the first aspect of the twin carburetor for the V-type engine on the basis of the present invention, it is possible to largely improve rigidity of the connection plate, it is possible to increase connection strength between the first carburetor and the second carburetor, and then it is possible to improve productivity of the cup member serving a function of the connection plate. Further, since the main driven throttle valve lever, the driven throttle valve lever and the connection lever are arranged so as to be received within the cup member closed by the cover member, it is possible to improve a toughness against the foreign materials, it is possible to largely reduce a maintenance area, and it is possible to improve an outer appearance of the carburetor, whereby the structure is suitable for the vehicle such as the two-wheeled vehicle or the four-wheeled vehicle in which the engine is directly exposed outside. Further, since rigidity of the cup member can be increased by the peripheral wall portion, the accelerator wire support portion and the threaded hole for the stop screw can be directly provided in the cup member, whereby the wire support portion and the threaded hole for the stop screw can be concentratedly arranged in the cup member. Further, in accordance with the second aspect of the present invention, since the main drive throttle valve lever constituted by the first main drive lever portion and the second main drive lever portion is received within the cup member via the first insertion hole, and the driven throttle valve lever constituted by the first driven lever portion and the second driven lever portion is arranged so as to be received within the cup member via the second insertion hole, the main drive throttle valve lever can be previously assembled in the first carburetor, and the driven throttle valve lever can be previously assembled in the second carburetor, so that productivity of the carburetor are not deteriorated even when the cup member is used. Further, in the case that the opening of the first insertion hole is closed by the end surface of the first closing boss in the first carburetor, and the opening of the second insertion hole is closed by the end surface of the second closing boss in the second carburetor, it is possible to further improve closing property within the cup member, and it is possible to more effectively inhibit the foreign materials from entering within the cup member. Further, in accordance with the third aspect of the present invention, is becomes easy to carry out the work for connecting the connection lever to the main driven throttle valve lever and the work for connecting the connecting lever to the driven throttle valve lever. At this time, it is possible to achieve improvement of the working property for adjusting by arranging the adjusting screw near the opening portion of the cup member. Still further, in accordance with the fourth aspect of the present invention, when water enters into the cup member, it is possible to immediately drain the water outside from the drain hole and it is possible to solve the problem caused by the water contents. In this case, the present invention is applied to the carburetor, however, it goes without saying that the present invention can be applied to a throttle body (mainly constituted by a throttle body through which an intake passage is provided, and a throttle valve opening and closing the intake passage) in a fuel injection apparatus.

What is claimed is:

1. A twin carburetor for a V-type engine provided with a first carburetor and a second carburetor which are connected to respective cylinders constituting the V-type engine, in which a main drive throttle valve lever provided in the first carburetor and a driven throttle valve lever provided in the second carburetor are connected in an interlocking manner by a connection lever, and the centers of intake passages of the respective carburetors are arranged on the same line, wherein a cup member (20) formed in a cup shape is provided with a peripheral wall portion (20B) upstanding from a bottom portion (20A) toward an above opening portion (20C), a wire support portion (20F) inserting for an accelerator wire (W) being inserted thereto, and a threaded hole (20H) for a stop screw, said cup member is arranged in parallel to the center of an intake passage (3, 11) in each of the carburetors (1, 9) and is arranged fixedly onto one side end surface (7A, 15A) of each of the carburetors (1, 9), the opening portion (20C) of said cup member is closed and held by a cover member (30), and the main drive throttle valve lever (8), the driven throttle valve lever (16) and the connection lever (41) are arranged so as to be received within the cup member (20) including the cover member (30).

2. A twin carburetor for a V-type engine as claimed in claim 1, wherein a first insertion hole (20D) capable of having the main drive throttle valve lever (8) inserted thereto and a second insertion hole (20E) capable of having the driven throttle valve lever (16) inserted thereto are provided in a bottom portion (20A) of said cup portion, the main drive throttle valve lever (8) is received within the cup member (20) via the first insertion hole (20D), the driven throttle valve lever (16) is received within the cup member (20) via the second insertion hole (20E), an opening portion of the first insertion hole (20D) is closed by an end surface (7A) of a first closing boss (7) provided in the first carburetor (1), and an opening portion of the second insertion hole (20E) is closed by an end surface (15A) of a second closing boss (15) provided in the second carburetor (9).

3. A twin carburetor for a V-type engine as claimed in claim 1, wherein said connection lever is arranged near the opening portion (20C) of the cup member (20).

4. A twin carburetor for a V-type engine as claimed in claim 1, wherein a drain hole (20G) is provided in a bottom portion of said cup member in the gravitational direction.

* * * * *